US011752775B2

(12) United States Patent
Krieger et al.

(10) Patent No.: US 11,752,775 B2
(45) Date of Patent: Sep. 12, 2023

(54) METHOD FOR DETERMINING PRINT DEFECTS IN A PRINTING OPERATION CARRIED OUT ON AN INKJET PRINTING MACHINE FOR PROCESSING A PRINT JOB

(71) Applicant: HEIDELBERG DRUCKMASCHINEN AG, Heidelberg (DE)

(72) Inventors: Jan Krieger, Heidelberg (DE); Frank Schumann, Heidelberg (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 471 days.

(21) Appl. No.: 16/740,687

(22) Filed: Jan. 13, 2020

(65) Prior Publication Data

US 2020/0223230 A1 Jul. 16, 2020

(30) Foreign Application Priority Data

Jan. 11, 2019 (EP) ..... 19151348

(51) Int. Cl.
*B41J 2/21* (2006.01)
*B41J 29/393* (2006.01)

(52) U.S. Cl.
CPC ..... *B41J 2/2142* (2013.01); *B41J 2/2139* (2013.01); *B41J 2/2146* (2013.01); *B41J 29/393* (2013.01); *B41J 2029/3935* (2013.01)

(58) Field of Classification Search
CPC ..... B41J 2/2142; B41J 2/2139; B41J 2/2146; B41J 29/393; B41J 2029/3935
See application file for complete search history.

(56) References Cited

U.S. PATENT DOCUMENTS 6,301,374 B1 10/2001 Stringa
9,944,104 B2 4/2018 Ukishima
(Continued)

FOREIGN PATENT DOCUMENTS

CN 1041563 A 4/1990
CN 1162141 A 10/1997
(Continued)

OTHER PUBLICATIONS

Li Xue-Wei et al.: "Application of Digital Image Processing Techniques in Quality Detection of Colour Printing", Journal Of Shandong, University of Technology (Sci & Tech), vol. 20, No. 5, Sep. 30, 2006—English abstract.

*Primary Examiner* — Bradley W Thies
(74) *Attorney, Agent, or Firm* — Laurence A. Greenberg; Werner H. Stemer; Ralph E. Locher

(57) ABSTRACT

A method for determining print defects in a printing operation carried out on an inkjet printing machine for processing a print job includes using a camera system to record and digitize printed products generated during the printing operation, feeding the camera image having been thus generated to a detection algorithm on the computer, alerting a machine control unit when print defects are found, and ejecting the printed product through a waste ejector if necessary. The detection algorithm separates color separations of the camera images, detects the print defects in the color separations, links images of the individual color separations to form a candidate image, filters the candidate image, enters the remaining detected print defects into a list, and forwards the list to the machine control unit of the printing machine.

15 Claims, 7 Drawing Sheets

(56) References Cited

U.S. PATENT DOCUMENTS

| | | | | |
|---|---|---|---|---|
| 9,953,435 | B2 | 4/2018 | Fergen et al. | |
| 10,214,017 | B2 | 2/2019 | Geissler et al. | |
| 10,311,561 | B2 | 6/2019 | Ukishima | |
| 2010/0072695 | A1 | 3/2010 | Grasmueck et al. | |
| 2012/0092409 | A1* | 4/2012 | Wu | B41J 2/2142 347/19 |
| 2018/0162134 | A1 | 6/2018 | Geissler et al. | |

FOREIGN PATENT DOCUMENTS

| | | | |
|---|---|---|---|
| CN | 101683930 | A | 3/2010 |
| CN | 102529445 | A | 7/2012 |
| CN | 106780438 | A | 5/2017 |
| CN | 106881956 | A | 6/2017 |
| CN | 107507172 | A | 12/2017 |
| CN | 108215508 | A | 6/2018 |
| DE | 102017220361 | A1 | 6/2018 |
| EP | 2626209 | A1 | 8/2013 |
| EP | 2801816 | A2 | 11/2014 |
| EP | 3300907 | A1 | 4/2018 |
| GB | 2222112 | A | 2/1990 |
| JP | 5956935 | B2 | 7/2016 |

* cited by examiner

METHOD FOR DETERMINING PRINT DEFECTS IN A PRINTING OPERATION CARRIED OUT ON AN INKJET PRINTING MACHINE FOR PROCESSING A PRINT JOB

CROSS-REFERENCE TO RELATED APPLICATION

This application claims the priority, under 35 U.S.C. § 119, of European Patent Application EP 19 151 348, filed Jan. 11, 2019; the prior application is herewith incorporated by reference in its entirety.

BACKGROUND OF THE INVENTION

Field of the Invention

The present invention relates to a method for examining the quality of a print created in an inkjet printing machine by using a camera and a computer.

The technical field of the invention is the field of digital printing.

In a printing operation on an inkjet printing machine, specific print defects occur that are specific to the type of printing machine in question. The most common defects are so-called white line defects, which occur when individual printing nozzles of the inkjet printing heads that are used deviate from the desired default behavior. When that deviation exceeds specified thresholds, the printing nozzles in question are generally deactivated because they affect the printed image. However, such a deactivated printing nozzle then creates a corresponding white line defect. The name of the defect derives from the fact that it is most pronounced in a solid area when the underlying printing substrate, which is generally white, becomes visible. When a bright color (e.g. opaque white) is printed onto a dark substrate, the defects occur as so-called dark line defects. Even in multicolor image areas where multiple printing nozzles of different printing heads print the individual color separations on top of one another, the failure or deactivation of a contributing printing nozzle results in corresponding color distortions in the printed image to be created. Since the printing nozzles apply ink in a line-shaped way in the direction of printing, the resultant print defect is line-shaped, too, hence the term white/dark line printing defect.

There are many causes for the occurrence of such deviations when printing nozzles are in operation. A major problem is that ink cakes when the corresponding printing head has not been in use for too long and has not been expertly stored in a stand-by condition. The caked ink blocks the nozzle exit, thus causing the printing nozzle in question to print a deviated print dot or even to fail completely. In any case, the printing nozzle does not print exactly where the actual print dot should be located, and the applied amount of ink likewise deviates from the desired default values. Apart from caked ink, dust particles and other dirt particles entering the nozzle may likewise cause white line defects.

Multiple approaches to detecting white line defects have become known in the art. The most common one certainly is to print test charts and to detect the white lines in an automated process of recording and analyzing the test charts. However, a disadvantage of that approach is that, depending on their sizes and positions on the printing substrate, the test charts create waste. Therefore, there are methods that examine the printed image itself to detect white line defects that have occurred in the print. A further advantage of that process is that it only detects those white lines (and the nozzles causing them) that actually have a negative effect on the printed image currently to be produced.

German Patent Application DE 2017 220 361 A1 discloses such a method for detecting and compensating for failed printing nozzles in an inkjet printing machine by using a computer. The method includes the steps of printing a current print image, recording the printed print image by using an image sensor and digitizing the recorded print image by using the computer, adding up digitized color values of the recorded print image of every column over the entire print image height and dividing the added color values by the number of pixels to obtain a column profile, subtracting an optimized column profile without any failed printing nozzles from the original column profile to obtain a differential column profile, setting a threshold for maximum values that define a failed printing nozzle when exceeded, applying the threshold for maximum values to the differential column profile, resulting in a column profile in which every maximum marks a failed printing nozzle, and compensating for the marked printing nozzles in the subsequent printing operation.

A disadvantage of that process is that it cannot be reliably executed in practice. The method is based on the fact that there are only very slight differences between a reference image and a camera image. Yet that is precisely what is not the case in practice. That is, for instance, due to the wrong camera calibration, a suboptimal or dated white balance, different paper types, or suboptimal inks in the printing unit. In addition, as far as possible, white lines are detected in solid areas of the printed image, which means that the method may only be used to a limited extent for printed images that do not have any such areas.

U.S. Pat. No. 9,944,104 B2 discloses a white line inspection system. That document proposes a simple threshold comparison to detect white lines, assuming that the image to be examined is homogeneous at the location in question. In the case of an image that does not meet that requirement, the document proposes to generate the signal by subtracting a locally aligned reference image obtained from pre-print data. However, the process still requires the calculation of a differential image.

In contrast, European Patent Application EP 3 300 907A1, corresponding to U.S. Pat. No. 10,311,561, describes how the quality of a white line detection system may be improved by using different processes as a function of the printing situation, in particular to avoid the detection of weak and therefore negligible white lines or of white lines that have been badly compensated for but are invisible to the human eye. Similarly to U.S. Pat. No. 9,944,104 B2, that document likewise requires a step of generating a reference image to generate reference data for detecting white lines—a step one would like to avoid.

Moreover, U.S. Patent Application Publication No. 2012/092409 A1 discloses a system and a method for detecting missing ink jets in an inkjet image generating system. The system and method detect missing ink jets in an inkjet image generating system. In that process, the system generates digital images of printed documents that do not contain test chart data. The digital images are processed to detect light strips, and the positions of the light strips are correlated with the ink jet positions in the print heads. The color of the ink that is associated with the correlated ink jet positions is then identified by analyzing color separations and/or color defects.

SUMMARY OF THE INVENTION

It is accordingly an object of the invention to provide a method for determining print defects in a printing operation carried out on an inkjet printing machine for processing a print job, which overcomes the hereinafore-mentioned disadvantages of the heretofore-known methods of this general type and which is more efficient than known methods and provides an improved and more reliable detection of print defects, in particular white lines.

With the foregoing and other objects in view there is provided, in accordance with the invention, a method for determining print defects in a printing operation carried out on an inkjet printing machine for processing a print job, the method being executed by a computer and comprising the steps of using a camera system to record and digitize printed products generated during the printing operation, feeding the camera image that has been generated in this way to a detection algorithm on the computer, alerting a machine control unit when print defects are found, and ejecting the printed product through a waste ejector if necessary. According to the method the detection algorithm separates color separations of the camera images, detects the print defects in the color separations, links images of the individual color separations to form a candidate image, filters the candidate image, and finally enters the remaining detected print defects into a list and forwards the list to the machine control unit of the printing machine.

Thus, the core of the method of the invention is to detect print defects directly in the generated camera image of the recorded and digitized printed product. The print defects are detected directly in the color separations since they are easier to find therein than in the composite camera image. Yet an important aspect in this context is that the print defects need to be detectible in the generated camera image in the first place. For instance, if the resolution of the generated camera image is too low, the information on the corresponding print defects is lost and the entire detection algorithm goes nowhere. Another important aspect is that the camera generally provides RGB images, thus clearly providing individual RGB color separations of the generated camera image and not CMYK color separations, which correspond to the color space of the inkjet printing machine that was used. However, this is not a problem for the method of the invention because what counts is the exact position of the corresponding print defects or rather, that print defects that affect the quality of the print are reliably detected at all. The computer may make corresponding color space transformations to determine the affected color separation in the machine color space, i.e. the ink color and thus the print head that caused the defect. In addition, in order to improve the detection algorithm, once the detection in the color separations has been completed, the individual color separations are recombined to form a joint candidate image. The joint image is then subjected to further filtering to ensure that truly only print defects that actually result in unusable prints are detected. In order to provide an identification of the printing nozzles that have caused the print defect at a later point, all columns in the candidate picture that contain a detected print defect are marked.

Advantageous and thus preferred further developments of the method will become apparent from the associated dependent claims and from the description together with the associated drawings.

Another preferred development of the method of the invention in this context is that the print defects are white line or dark line defects caused by defective printing nozzles in the printing machine. Thus, the major task of the algorithm is to detect the white line defects described above, since these are major print defects that affect the quality of the printed product to such an extent that the products are unusable.

A further preferred development of the method of the invention in this context is that in a further step of the method, the computer applies a specific testing method to filter out pseudo white or dark line defects from the list of white line or dark line defects before the step of forwarding to the printing machine. An important aspect in this context is that the detection algorithm must not provide any false positives. In particular, thin bright lines in the image to be printed, for instance bar codes, are prone to being marked as pseudo white lines. Therefore, in a further step, in order to prevent intentional elements of the print from being falsely identified as white line defects and inadvertently producing additional waste, the detection algorithm ought to apply specific tests to check whether the detected white line actually is a genuine white line.

An added preferred development of the method of the invention in this context is that the computer determines the defective printing nozzles that caused the defects on the basis of the list of remaining detected white or dark line defects and, as a function thereof, compensates for the white or dark line defects by respective suitable compensation methods. Although the actual goal of the method of the invention is to provide a targeted way of identifying printed products in the form of print sheets that have such a white line defect and are therefore waste sheets, the information on white line defects provided by the detection algorithm may, of course, be used to find the cause of the defect, namely the defective printing nozzle, and to compensate for it by using a suitable compensation process. When the defective printing nozzles have been compensated for, the inkjet printing machine in question may continue to be used for the completion of the current print job without any print head change.

An additional preferred development of the method of the invention in this context is that the computer uses pre-print data of the print job to create a reference image for the specific testing method, applies the detection algorithm to the reference image and thus either obtains information on resultant candidates for pseudo white or dark line defects and eliminates them from the list of white or dark line defects or obtains information on areas in the camera image with probable pseudo white or pseudo line defects and therefore does not apply the detection algorithm to the areas in the camera image. The easiest way to detect pseudo white lines is to create a reference image out of good data, for instance pre-print data, and to check whether the detected structure that has been identified as a white line is present in the reference image. If this is the case, of course a pseudo white line is being dealt with. This realization may be dealt with in two different ways. One may simply remove the detected pseudo white line defect from the list. This is certainly the easiest way to proceed. Yet if one wants to avoid the detection algorithm continuing to find the same pseudo white line in the further course of the method of the invention, the best way to proceed is to exclude the area in which the pseudo white line defect occurred in the camera image from the detection process of the invention.

Another preferred development of the method of the invention in this context is that the computer creates the reference image in multiple sizes and/or resolutions, accordingly applies the detection algorithm multiple times to the different reference images, and summarizes the obtained information and uses it. This way to proceed increases the reliability of the detection algorithm both for the specific marking of white lines and for the detection of pseudo white line defects.

An added preferred development of the method of the invention in this context is that the algorithm is not applied to areas distinguished by great variation of the gray values in a limited local environment in the reference image or that results of such areas are excluded. Such areas, for instance bar codes, are particularly prone to the detection of pseudo white line or dark line defects and therefore need to be excluded from the analysis by the algorithm.

An additional preferred development of the method of the invention in this context is that the list of white line or dark line defects is created through column totals in the filtered candidate image by applying a threshold value to the respective calculated column total in the candidate image. Genuine undesired white/dark line defects usually extend over a larger area of the recorded camera image. In order to prevent very small, short failures of an individual printing nozzle from resulting in the detection of a print defect even though it may not be visible or be a pseudo white/dark line defect, which is very probable if the white line defect is very short, only print columns having a detected print defect which exceeds a specified threshold are marked in the candidate image.

Another preferred development of the method of the invention in this context is that the computer links the candidate images of the individual color separations by a mathematical OR operation. This way of combining the individual color separations to form the candidate image has proved to be most suitable in terms of computing.

An added preferred development of the method of the invention in this context is that the computer filters the candidate image using morphological operations. This allows, in particular, very short print defects/white lines, which in most cases are pseudo white lines anyway or do not have a serious effect on the quality of the generated printed product/sheet, to be filtered out so that the product in question need not be considered waste.

An additional preferred development of the method of the invention in this context is that the computer applies the detection algorithm to the generated camera image multiple times with different parameters to detect different manifestations of dark or white line defects and that the results of all color separations of all applications of the method are linked by a logic operation. In addition to applying the detection algorithm multiple times to multiple reference images, which is an optional step of the method of the invention, the detection algorithm may be applied multiple times to the generated camera image. This, in particular, enhances the accuracy of the detection algorithm when pseudo white or dark line defects are filtered out and improves the detection of genuine white or dark line defects.

Another preferred development of the method of the invention in this context is that for a respective one of the applications of the method with different parameters, every pixel of the camera image is in advance limited to a maximum gray value. An advantage of this feature is that bright outliers in paper white areas, which might falsify the average, are filtered out.

A further preferred development of the method of the invention in this context is that the creation of the candidate image of a color channel is achieved by dividing the image into horizontal stripes, every stripe is reduced to an image signal by a suitable averaging of every one of its columns, white or dark lines are searched for in a specific search process in the image signal, and every row that has been analyzed in this way becomes a row of the white line candidate image. This is an important feature of the method of the invention since the white/dark line detection by using the detection algorithm is more efficient in these stripes than if the algorithm had to work with the entire image.

An added preferred development of the method of the invention in this context is that using the white or dark line search process, the computer detects a dark or white line at a position by analyzing a limited vicinity about the pixel in question in the image signal. The decision whether a detected defect is a genuine white or dark line defect is done by assessing the immediately neighboring pixels. Due to this feature, a pseudo white or dark line defect can be ruled out.

A concomitant preferred development of the method of the invention in this context is that the search process initially convolutes the image signal with different kernels and converts the results into logic signals by a comparison with respective potentially different threshold values and that the signals are then converted into a white or dark line candidate image signal by using a logic operation.

Other features which are considered as characteristic for the invention are set forth in the appended claims. The invention as such as well as further developments of the invention that are advantageous in structural and/or functional terms will be described in more detail below with reference to the associated drawings and based on at least one preferred exemplary embodiment.

Although the invention is illustrated and described herein as embodied in a method for determining print defects in a printing operation carried out on an inkjet printing machine for processing a print job, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
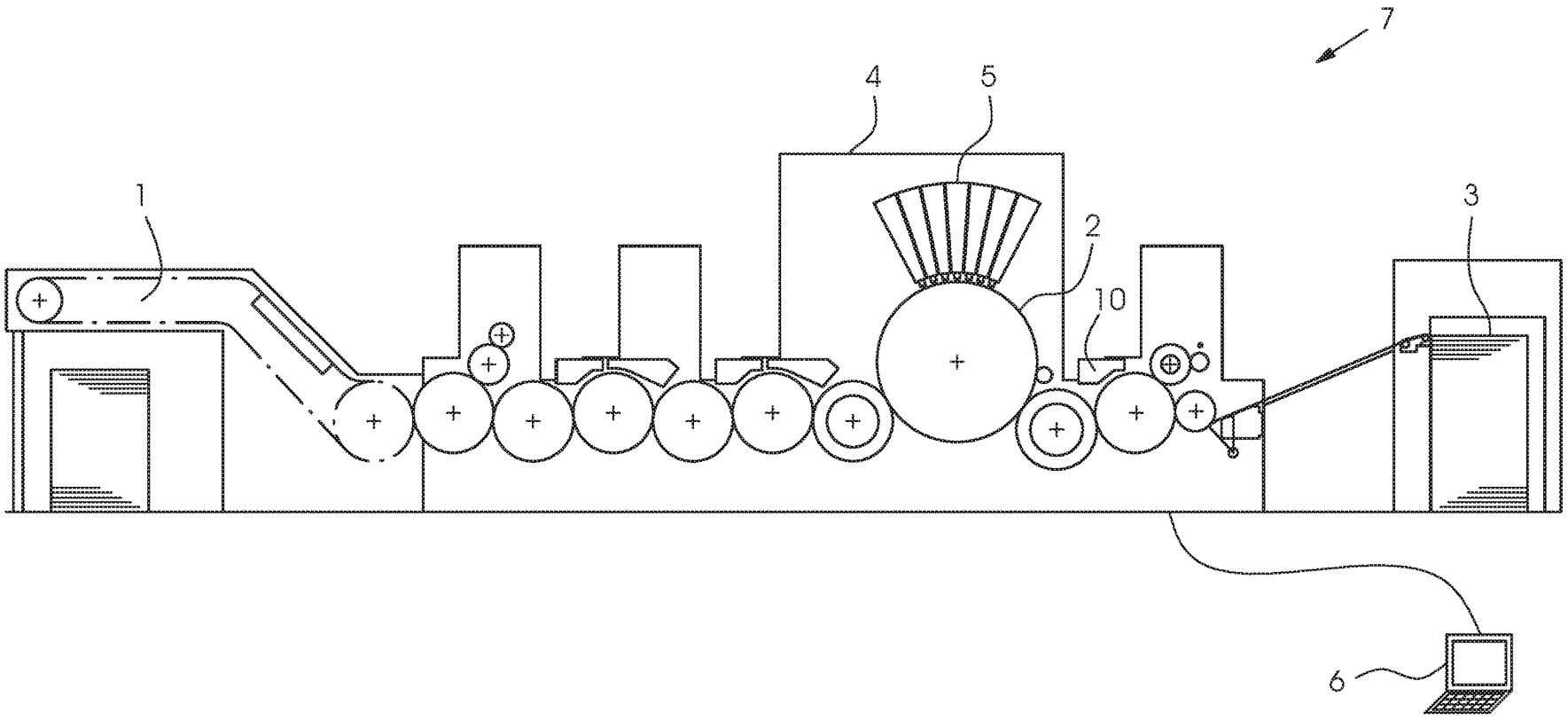
FIG. 1 is a diagrammatic, longitudinal-sectional view of an example of the structure of a sheet-fed inkjet printing machine.
Figure 3:
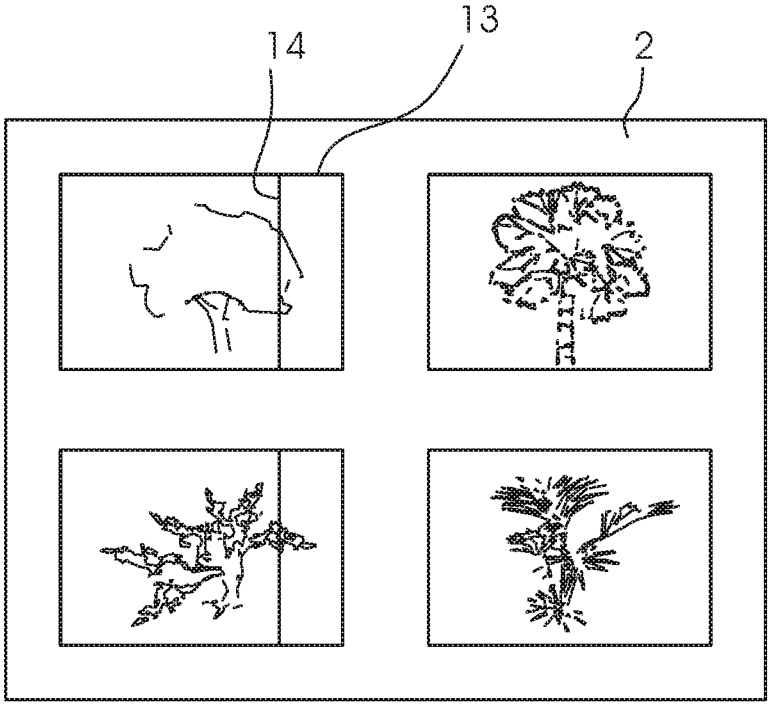
FIG. 3 is a top-plan view of an example of a recorded camera image on a sheet.

Referring now in detail to the figures of the drawings, in which mutually corresponding elements have the same reference symbols, and first, particularly, to FIG. 1 thereof, it is seen that the field of application of the preferred exemplary embodiment is for an inkjet printing machine 7. FIG. 1 shows an example of the fundamental construction of such a machine 7, including a feeder 1 for feeding a printing substrate 2, in general a sheet 2, to a printing unit 4, where it receives an image printed by print heads 5, as well as a delivery 3. The machine is a sheet-fed inkjet printing machine 7 controlled by a control unit or computer 6. While this printing machine 7 is in operation, individual printing nozzles in the print heads 5 in the printing unit 4 may fail as described above. Such a failure results in white or dark lines or, in the case of multicolor printing, in distorted color values. An example of such a white/dark line 14 in a recorded camera image 13 is shown in FIG. 3.

Figure 2:
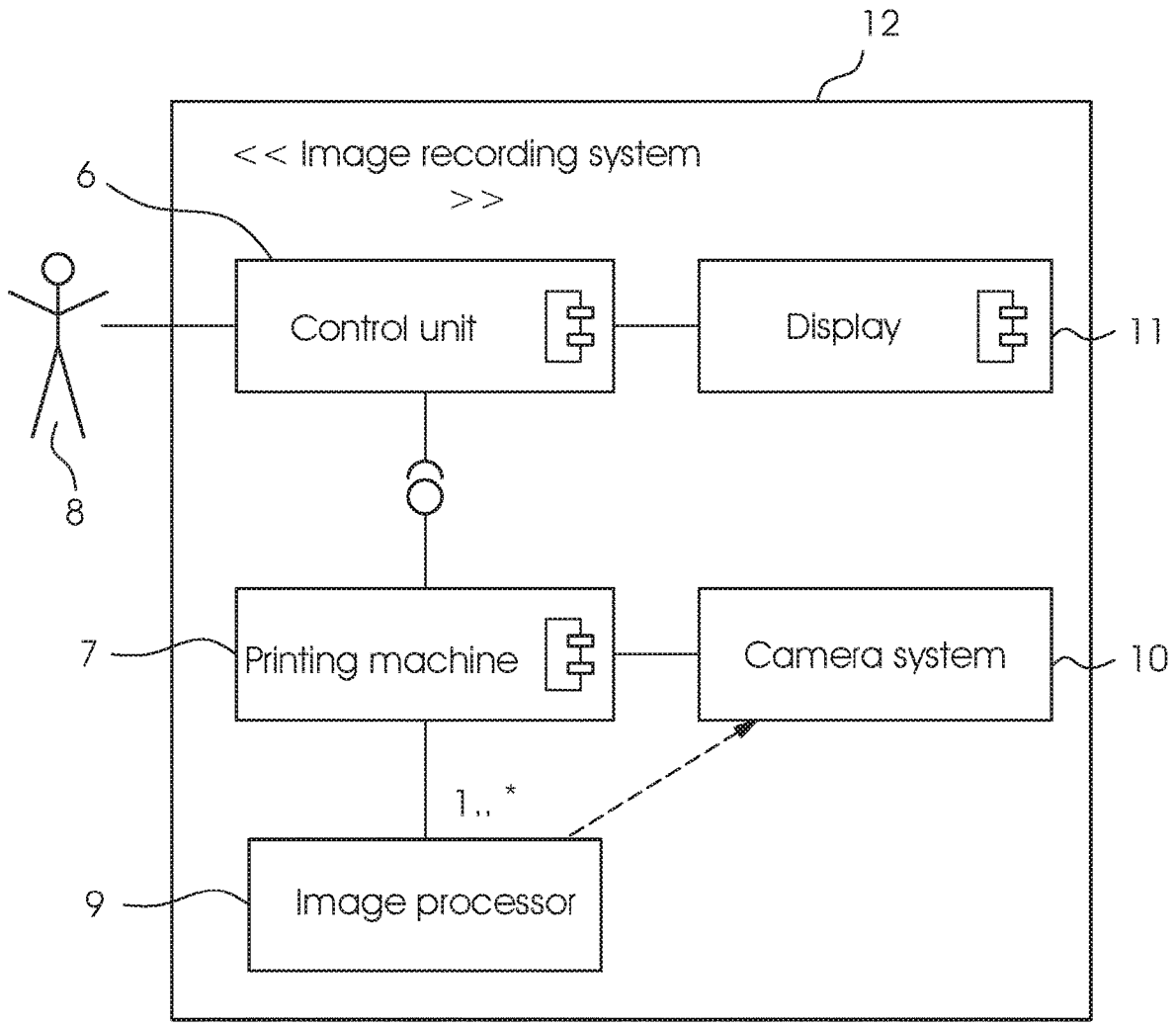
FIG. 2 is a block diagram of an example of an image recording system used for print inspection purposes.
Figure 10:
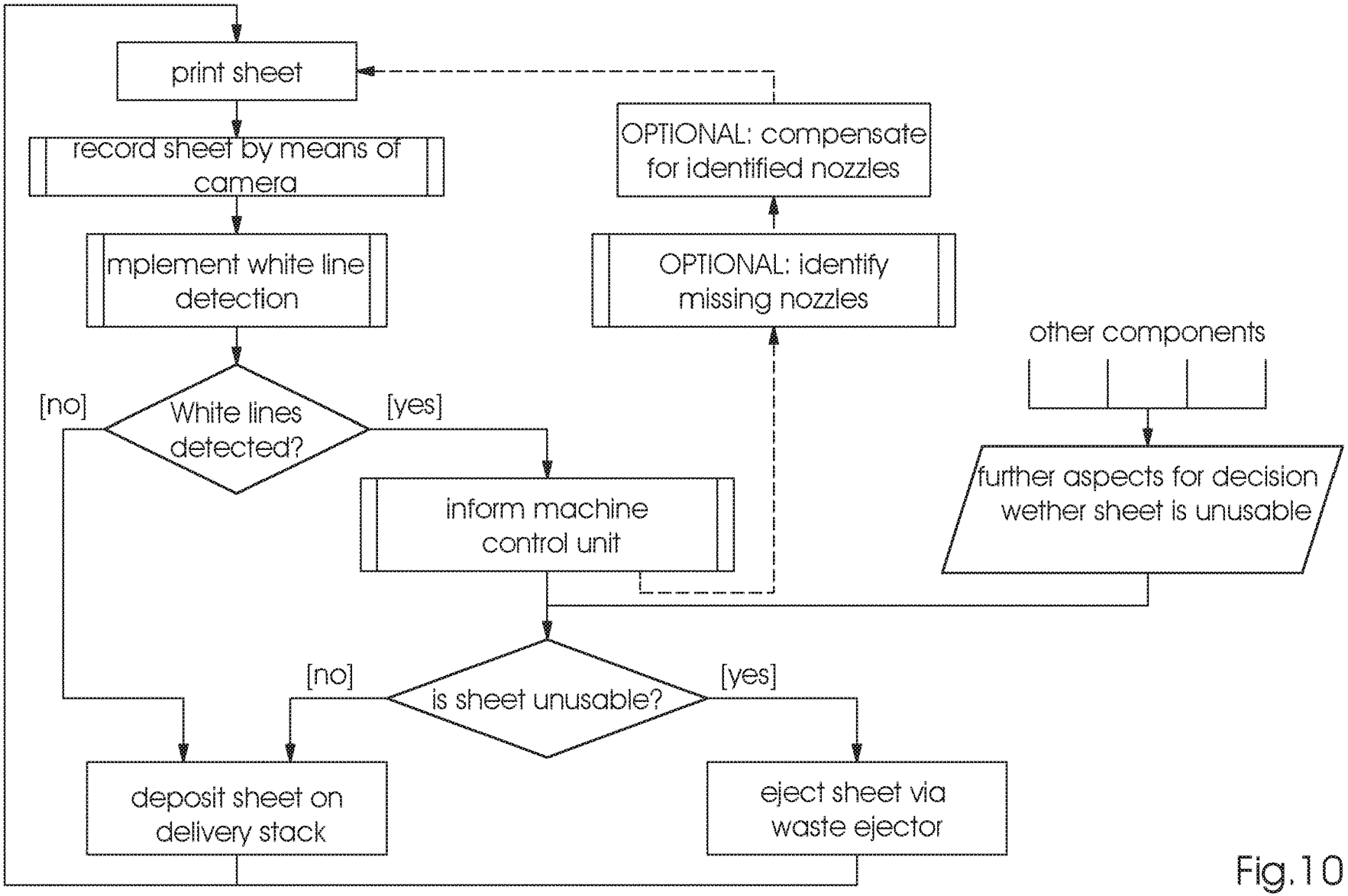
FIG. 10 is a flow chart of the method of the invention.

In contrast to the known methods of the prior art, the method of the invention proposes a different way of embedding the process of detecting white/dark lines 14 into the total sequence of steps of the printing operation and no longer requires any operator intervention. The sequence of steps of a first preferred embodiment is schematically shown in FIG. 10:

1. After printing, a camera system 10 that is part of an in-line image recording system 12 digitizes the printed sheet. FIG. 2 illustrates an example of such an image recording system 12 that is used in the method of the invention. The system is formed of at least one image sensor 10, usually a camera 10, which is integrated into the inkjet printing machine 7. The at least one camera 10 records the images 13 generated by the printing machine 7 and transmits the data to a computer 6, 9 for analysis. This computer 6, 9 may be a separate computer 9, e.g. one or more dedicated image processors 9, or it may be identical with the control unit 6 of the printing machine 7. At least the control unit 6 of the printing machine 7 has a display 11 for displaying the results of the image inspection process to an operator 8. The method of the invention described below is preferably executed by an image processing algorithm running on the image processor 9. The camera image 13 created in this way has a lower resolution than the print. A common camera resolution is 670 dpi, whereas the print resolution is 1200 dpi. The resolution and the optical system need to be selected in such a way that white/dark lines 14 are manifest as brighter stripes that are one to two camera pixels wide. If the resolution is too high, the first step may be to lower the resolution of the image 13 down to a matching resolution by known image processing methods; in particular pyramidal image representations may turn out to be useful in this context.
2. The camera image 13 is forwarded to a white/dark line detection algorithm, which will be described in more detail below. In parallel, it may be used in further analyses.
3. When the detection algorithm detects white/dark lines 14, the image processor 9 alerts the control unit 6 of the printing machine 7 to their presence. In combination with other data from the printing machine 7, the control unit 6 then decides whether the printed sheet 2 is waste and needs to be ejected through a waste ejector.
4. The detected white/dark lines 14 may optionally be subjected to a more detailed analysis to identify the defective nozzle and to use this information to compensate for the defective nozzle.

This sequence of steps illustrates that it is important for the entire system 12 that the processing of the camera images 13 keeps pace.

In contrast to the prior art, the aforementioned algorithm for detecting white/dark lines is now only applied to the camera image 13. FIG. 3 illustrates an example of a printed sheet 2 with recorded camera images 13, one of which exhibits a white/dark line defect 14. In accordance with a further embodiment, additional filtering with the aid of a reference image may nevertheless be done at a later point. This aspect will be explained in more detail in the course of the present description.

Figure 4:
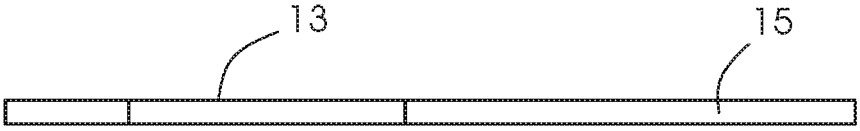
FIG. 4 is a side-elevational view of a stripe of the recorded camera image.
Figure 5:
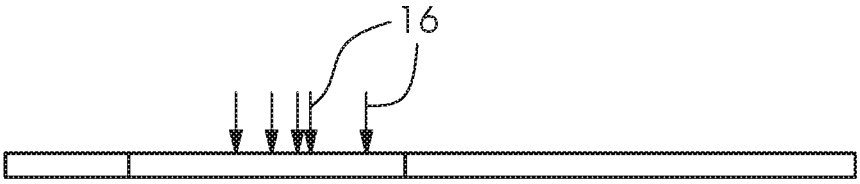
FIG. 5 is a side-elevational view of a stripe of the recorded camera image including marked white lines.
Figure 6:
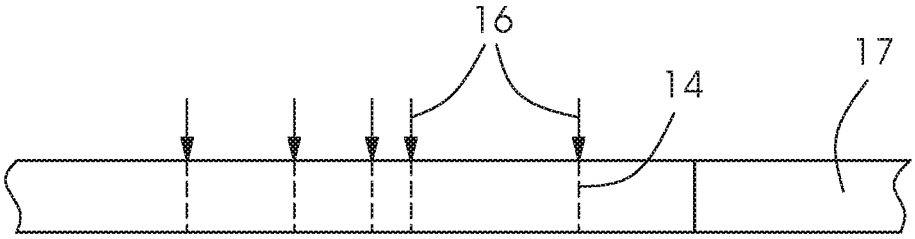
FIG. 6 is a side-elevational view of an enlarged section with marked white lines in the stripe of the recorded camera image.
Figure 7:
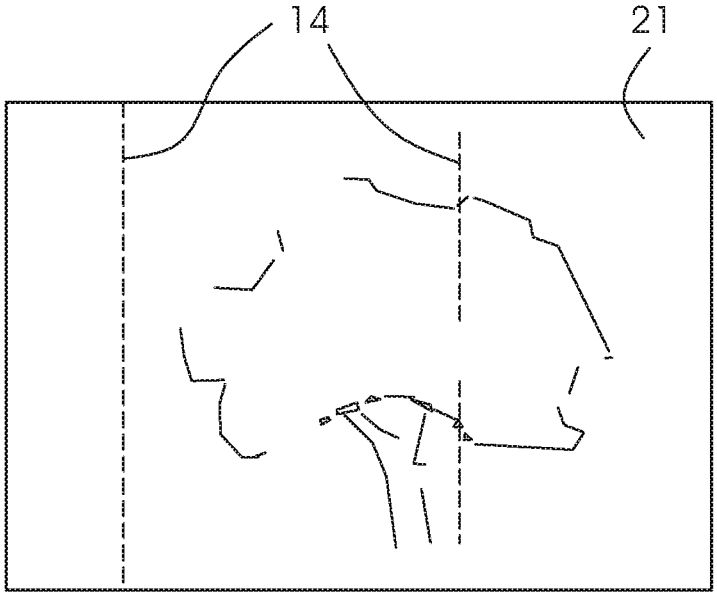
FIG. 7 is a top-plan view illustrating an image composed of image stripes with marked white line candidates.

The detection algorithm is based on subdividing the recorded camera image 13 into horizontal stripes 15, 15*a*, 15*b*. The algorithm includes the following steps:

1. Separate the RGB color separations and, in a separate operation for every color separation C:
1.1 Divide the camera image 13 into stripes of a height of 1-10 mm (see FIG. 4).
1.2 Every stripe 15 is averaged in the direction of travel of the sheet 2, i.e. in the y direction. The result is a signal $I_s(x)$ for the $s^{th}$ stripe 15.
1.3. In every stripe 15, white/dark lines are separately detected by calculating a truth value for every x position:
1.3.1. In an optional step, pixels with gray values $I_{C,s}(x) > G_{max}$ are ignored because white/dark lines 14 do not become visible in bright image areas.
1.3.2 $WLC(x,s)=(I_{C,s}(x)-I_{C,s}(x-1)>L)$ and $((I_{C,s}(x)-I_{C,s}(x+1)>L)$ or $(I_{C,s}(x)-IC,s(x+2)>L))$ or $(I_{C,s}(x)-I_{C,s}(x-2)>L)$ and $((I_{C,s}(x)-I_{C,s}(x+1)>L))$
This expression checks whether there is a white/dark line of a width of one or two pixels that is brighter by more than L gray scales and excludes edges in the image in an effective way. FIGS. 5 and 6 illustrate an image stripe 15 with detected white/dark lines 14 that have been provided with a corresponding mark 16. FIG. 6 illustrates an enlarged section 17 of the stripe 15 with a mark 16 and white/dark line 14.
1.4. The result is a black-and-white image WLCC (x,y) that indicates all white/dark line candidates 14.
2. The images $WLC_C(x,y)$ of the individual color separations are then combined using an OR operation to form a single candidate image WLC(x,y) 21, which is shown by way of example in FIG. 7. FIG. 7 shows an image 21 composed of image stripes 15 and including marked white/dark line candidates 14.
3. The image WLC(x,y) 21 may now be subjected to filtering with morphological operators. For instance, eroding with a structure element SE in the form of 0 1 0

0 1 0 filters out very short white/dark lines 14. The SE level may be variable to allow a minimum length of the detected white/dark lines 14 to be preset.

4. In a further exemplary embodiment, the same analysis described in steps 1 to 3 may be applied in parallel to a potentially existing reference image, which is directly generated by the RIP as an RGB image. The resultant white/dark line candidates $WLC_{REF}(x,y)$ 14 mark areas in the printed image in which detected white/dark lines are probably false positives triggered by the customer's image. These areas ought to be removed from the image WLC(x,y) 21 of the camera image 13. For this purpose, the areas in $WLC_{REF}(x,y)$ are widened with the aid of morphological dilatation. This corresponds to a smoothing of $WLC_{REF}(x,y)$. Then WLC(x,y) 21 is filtered by $WLC_{REF}(x,y)$:

$$WLC(x,y) \leftarrow WLC(x,y) \text{ and (not } WLC_{REF}(x,y))$$

5. Finally all columns $C_{WL}$ in WLC(x,y) 21 that contain a white/dark line 14 are detected. This may be done using a threshold value minWLPerColumn for the column total, namely encoded as: no white/dark line=0, white/dark line=1 in WLC(x,y) 21, i.e. counting the entries in WLC(x,y) 21 marked as white/dark line 14:

$$CWL=\{|\Sigma_y WLC(x,y)>\min WL\text{PerColumn}\}$$

In further preferred embodiments, the method of the invention may additionally be adapted:

For instance, the subsequent filters may be varied.

The number of white/dark line candidates 14 needs to reach a minimum number per column to be marked as a white/dark line 14.

A maximum brightness value of the pixels is defined to prevent very bright pixels from falsifying the average. A white/dark line 14 does not have any very bright pixels in a 670 dpi camera image 13. I.e. all gray values in the image >50 are limited to 50.

The reference image is analyzed to find out whether relevant locations in the reference image have strong structures that lead to structures similar to white/dark lines and therefore need to be excluded from the camera image 13. For this purpose, the reference image does not need to be present in full resolution because only a rough estimate is required to decide whether the reference image area has structures or is homogeneous (see step 4).

The method described above may be implemented on a graphics processing unit (GPU) as a computing accelerator.

Figure 8:
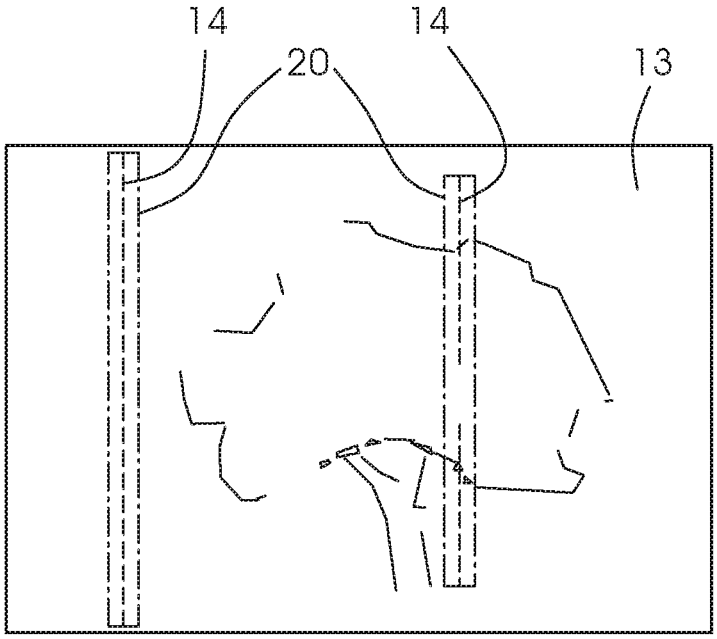
FIG. 8 is a top-plan view illustrating marked white line areas in a camera image.

The detection algorithm described above may be implemented as a component of the image recording system 12 that executes the image inspection process. The WLC(x,y) image 21 may then be used to obtain data for a report to an operator 8 or customer by recognizing coherent areas (blobs) in the image 13 and marking them in a survey image for the operator 8 in a later analysis. FIG. 8 illustrates an example of a camera image 13 with marked white/dark line areas 20 as a part of such a report.

Yet in most cases, these further preferred embodiments require a reference image, which affects the processing speed in addition to the disadvantages that have been indicated above. However, the use of a reference image may further improve the quality of the method of the invention because it helps to avoid false positives in the white/dark line 14 detection process.

Thus, the method of the invention has many advantages over the prior art. For instance, if there are considerable color deviations between the desired image and the camera image 13, for instance if the work flow has been wrongly calibrated in terms of cameras 10, white comparison, type of paper, short white/dark lines 14 are often submerged in the image/signal noise. The method of the invention overcomes this disadvantage. Furthermore, the prior art methods require the reference image to be supplied to the computer 9 at the full resolution of, for instance, 670 dpi. Using the technical measures that are available today, this is a very expensive process. Since the algorithm presented herein does without a reference image or at least without a high-resolution reference image, these costs are saved. After all, the detection in principle does not require any reference image, even though a reference image may be used to eliminate false positives caused by structures in the customer's image from the white/dark line detection process. Specifically, no direct comparison is required between the reference image and the camera image 13 to detect the white/dark line candidates 14.

In addition, there is a further, particularly preferred exemplary embodiment of the method of the invention that improves the method even further, proposing the following two-stage algorithm based on the previous embodiment:

Stage one is specifically to look for white/dark line candidates 14.

For this purpose, the algorithm presented in the previous exemplary embodiments is called up a number of times using different parameters. The results of these runs of the algorithm are then logically linked. In addition, the sequences of the algorithm are further improved. This is done as follows:

The algorithm is applied to the camera image 13 on the sheet 2 multiple times. For different applications, the parameters are adapted as follows:

1. The gray scales/color channel values of the camera image 13 are compressed. In the compression process, brightness values above a threshold $S_{max}$ are limited to the threshold $S_{max}$. This effectively suppresses all structures brighter than $S_{max}$ in the image 13. This step detects white/dark lines 14 in dark areas in homogeneous and inhomogeneous areas very well. This compression is made before the first step of the previous exemplary embodiment.
2. In this case, too, the gray scales/color channel values of the camera image 13 are compressed. However, in this compression process, brightness values above a threshold $K_{max}$ ($K_{max}>S_{max}$) are limited to the threshold $K_{max}$. The compression is made before the third step of the previous exemplary embodiment. In addition, the local homogeneity of the image 13 is calculated by calculating the standard deviation of the column segment when the averaging is done in the second step of the previous exemplary embodiment. Only white/dark lines 14 in relatively homogeneous areas, i.e. at a standard deviation $<\sigma_{max}$ are entered into the candidate list. This filter may be applied in the third step of the previous embodiment. This approach detects white/dark lines 14 in bright homogeneous areas very well. In bright inhomogeneous areas, the human eye has difficulties detecting white/dark lines 14 anyway; thus they are ignored.

Both results are linked using an OR operation and combined to form a white/dark line candidate list. Optionally, even more complex links with further information are conceivable.

Furthermore, in the second step of the previous embodiment, different averaging processes with advantageous properties other than simple averaging may be applied to an image signal that has been generated, among them, for instance:

Median instead of average; the advantage being that the method is not sensitive to outliers.

Figure 9:
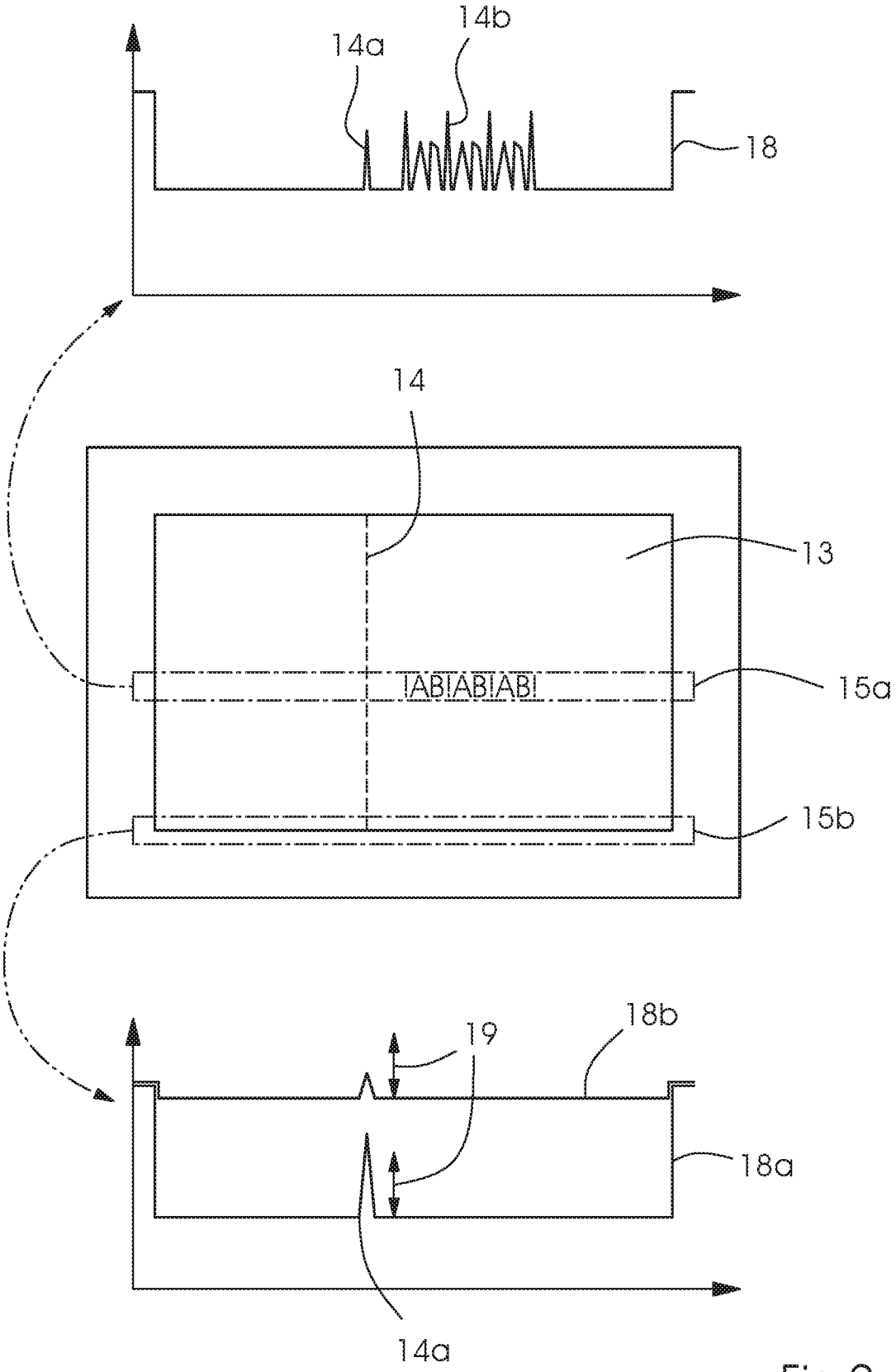
FIG. 9 is a diagram illustrating a column average disturbance due to bright paper white areas or individual bright pixels.

Average only of pixels having a brightness value which does not exceed a maximum brightness value $G_{max,mean}$; the advantage being that bright outliers or paper white areas that might falsify the average are filtered out. This is shown by way of example in FIG. 9, which clearly indicates how the column average is affected in the upper and lower part of FIG. 9 due to bright paper-white areas or bright individual pixels. However, a problem in this context is the occurrence of pseudo white/dark lines 14*b* and a lack of contrast of the recorded printed image 13. In the central part, the printed image 13 recorded by the camera 10 is shown with a white/dark line defect 14. From this printed image 13, a stripe including text 15*a* and a stripe at the image margin 15*b* are cut out to generate respective image signals 18, 19 based thereon. In the image signal 18 of the stripe with the text 15*a*, the aforementioned effect of the white/dark line defect 14 in the signal is clearly visible in the shape of a corresponding peak 14*a* in the signal 18. In addition, the figure shows a peak due to a pseudo white/dark line defect 14*b* caused by the text. The figure shows that it is difficult to differentiate between a peak of a genuine white/dark line defect 14*a* and a peak 14*b* of a pseudo white/dark line defect 14*b* because both peaks 14*a*, 14*b* exceed the minimum detection level 19. In the lower part, two image signals 18*a*, 18*b* for the case of the generated signal of the image margin are shown. In this case, the minimum detection level 19 is only exceeded in the signal with enhanced contrast 18*a*, thus ensuring that the white/dark line 14 is reliably detected. In the second signal with lower contrast 18*b*, the minimum detection level 19 is not exceeded and thus the white/dark line 14 is not detected.

In the third step of the previous exemplary embodiment, white/dark lines 14 are detected by using a threshold L. In this further embodiment, two improvements for the threshold are found:

1. Two thresholds are used depending on whether the width of the detected white/dark line 14 is a single pixel or two pixels. Depending on the resolution of the camera, it may furthermore be expedient to find even white/dark lines 14 that are 3, 4, N pixels wide. In such a case, a corresponding number of thresholds need to be applied. With the two thresholds L1 and L2, the detection expression from the third step is:

$$WLC(x,s)=((I_{C,s}(x)-I_{C,s}(x-1)>L1) \text{ and } (I_{C,s}(x)-I_{C,s}(x+1)>L1)) \text{ or } (I_{C,s}(x)-I_{C,s}(x-1)>L2) \text{ and } (I_{C,s}(x)-I_{C,s}(x+2)>L2)) \text{ or } ((I_{C,s}(x)-I_{C,s}(x-2)>L2) \text{ and } (I_{C,s}(x)-I_{C,s}(x+1)>L2))$$

2. The threshold may be made to depend on the local environment of every pixel x, which means that higher thresholds are applied to find white/dark lines 14 in bright image areas than in less bright areas. As a measure for the local brightness, an average of the gray values in a close vicinity of position x may be calculated excluding any white/dark line 14 that may be present.

Alternatively, a sliding median filter may be applied to $I_{C,s}(x)$.

As a further advantageous improvement of the previous exemplary embodiment, the algorithm may not be applied to a RGB image 13. Instead, the RGB image 13 is previously converted into a gray scale image that has the best possible contrast for white/dark lines 14 using a suitable method. Suitable transformation operations for this purpose are:

calculating the luminance channel from the Lab color space calculating the brightness value or saturation value from the HSB color space averaging the suitably weighted RGB color channels in a way adapted to the human eye In stage 2, one or more filters are applied to filter the pseudo white/dark lines 14*b* out of the white/dark line candidates 14 that have been identified in stage 1. For this purpose, there are the following improvements over the previous exemplary embodiment:

By applying a column filter to the white/dark line candidate list, all white/dark line candidates 14 that do not have at least a number $N_{col,min}$ of further white/dark line candidates 14 in one and the same image column are removed from the white/dark line candidate list. The concept behind this filter is to eliminate very short or isolated defects. For in most realistic prints, a white/dark line 14 will have an effect on more than one area of a column whereas false positives only occur in a locally isolated way.

The filter described above in step four of the previous exemplary embodiment and involving the aid of the reference image will be applied in this case, too, with all modifications described above. In this context, the size of the reference image is adapted in advance as an improvement. It may likewise be expedient to process the reference image multiple times at different resolutions and to combine the results of these stages before the filtering process. This simulates a loss of quality of the "perfect" reference image due to the camera system 10, thus effectively allowing the detection of different structures that may result in white/dark line-like structures in the camera image 13.

A particular additional advantage which the particularly preferred further exemplary embodiment has over the previous exemplary embodiment is that the performance in terms of the detection of white/dark lines 14 is better while fewer pseudo white/dark lines 14*b* are detected at the same time. However, for this purpose, a reference image analysis is required, involving additional process steps and taking up more computing times on the computer 6, 9 that is used. Thus, a decision on which preferred exemplary embodiment is to be used ought to be made on the basis of the requirements of the specific application. For print jobs for which white/dark line detection is critical in terms of time or performance, it is the first exemplary embodiment presented herein that ought to be used, whereas for print jobs that require especially thorough white/dark line 14 detection and/or that run an increased risk of a detection of pseudo white/dark lines 14*b* it is the second exemplary embodiment presented herein that ought to be used.

LIST OF REFERENCE SYMBOLS

1 feeder
2 printing substrate
3 delivery
4 inkjet printing unit
5 Inkjet printing head
6 control computer of the inkjet printing machine
7 inkjet printing machine
8 operator
9 image processor
10 image sensor/camera
11 display
12 image recording system

13 recorded print image
14 white/dark line print defect
14*a* peak of a white/dark line in the generated image signal
14*b* peak of a pseudo white/dark line in the generated image signal
15 stripe of the recorded print image
15*a* stripe of a recorded print image with text content
15*b* stripe of a recorded print image at the image margin
16 detected and marked white/dark lines
17 enlarged section of the stripe of the recorded print image
18 generated image signal of the stripe of the recorded print image with text content
18*a* generated image signal of the stripe of the recorded print image at the image margin
18*b* generated image signal of the stripe of the recorded print image at the image margin
19 minimum detection threshold of a white/dark line in the generated image signal
20 marked white/dark line areas #
21 candidate image composed of stripes

The invention claimed is:

1. A method for determining print defects in a printing operation carried out on an inkjet printing machine for processing a print job, the method comprising the following steps:

using a camera system to record and digitize printed products generated during the printing operation;

feeding a camera image generated in the camera system to a detection algorithm on a computer, using the detection algorithm to separate color separations of the camera images, detect the print defects in the color separations, link images of individual color separations to form a candidate image, filter the candidate image, enter remaining detected print defects into a list, and forward the list to a machine control unit of the printing machine;

alerting the machine control unit when print defects are found; and ejecting a printed product by using a waste ejector if necessary.

2. The method according to claim 1, wherein the print defects are white or dark line defects caused by defective printing nozzles in the inkjet printing machine.

3. The method according to claim 2, which further comprises using the computer to apply a specific testing method to filter out pseudo white or dark line defects from the list of white line or dark line defects before the step of forwarding to the machine control unit of the printing machine.

4. The method according to claim 2, which further comprises using the computer to:

determine the defective printing nozzles that caused the defects on the basis of the list of remaining detected white line or dark line defects; and as a function of the determined defective printing nozzles that caused the defects, to compensate for the white or dark line defects by using respective suitable compensation methods.

5. The method according to claim 4, which further comprises using the computer to:

employ pre-print data of the print job to create a reference image for the specific testing method; and apply the detection algorithm to the reference image and thus either:

obtain information on resultant candidates for pseudo white or dark line defects and eliminate them from the list of white or dark line defects, or obtain information on areas in the camera image with probable pseudo white or pseudo line defects and therefore not apply the detection algorithm to these areas in the camera image.

6. The method according to claim 5, which further comprises using the computer to:

create the reference image in at least one of multiple sizes or resolutions;

accordingly apply the detection algorithm multiple times to the different reference images; and summarize and use the obtained information.

7. The method according to claim 6, which further comprises not applying the algorithm to areas characterized by great variation of the gray values in a limited local environment in the reference image or wherein results of such areas are excluded.

8. The method according to claim 1, which further comprises using the computer to create the list of white line or dark line defects through column totals in the filtered candidate image by applying a threshold value to the respective calculated column total in the candidate image.

9. The method according to claim 1, which further comprises using the computer to link the candidate images of the individual color separations by a mathematical OR operation.

10. The method according to claim 1, which further comprises using the computer to filter the candidate image using morphological operations.

11. The method according to claim 1, which further comprises using the computer to apply the detection algorithm to the generated camera image multiple times with different parameters to detect different manifestations of dark or white line defects, and logically interlinking results of all color separations of all applications of the method.

12. The method according to claim 11, which further comprises limiting every pixel of the generated camera image in advance to a maximum gray value, for a respective one of the applications of the method with different parameters.

13. The method according to claim 1, which further comprises creating the candidate image of a color channel by:

dividing the generated camera image into horizontal stripes;

reducing every stripe to an image signal by a suitable averaging of every one of its columns;

searching for white or dark lines in a specific search process in the image signal; and using every analyzed row as a row of the white line candidate image.

14. The method according to claim 13, which further comprises using the white or dark line search process to detect a dark or white line at a position by examining a limited vicinity about a pixel in the image signal.

15. The method according to claim 14, which further comprises using the search process to initially convolute the image signal with different kernels and convert results into logic signals by a comparison with respective potentially different threshold values, and then converting the signals into a white or dark line candidate image signal by using a logic operation.

* * * * *